US008132573B1

(12) United States Patent
Jones

(10) Patent No.: US 8,132,573 B1
(45) Date of Patent: Mar. 13, 2012

(54) CURLING IRON WITH RETRACTABLE HEAT SHIELD

(76) Inventor: Barbara Jones, Mccalla, AL (US)

( * ) Notice: Subject to any disclaimer, the term of this patent is extended or adjusted under 35 U.S.C. 154(b) by 180 days.

(21) Appl. No.: 12/686,525

(22) Filed: Jan. 13, 2010

(51) Int. Cl.
*A45D 6/18* (2006.01)
*A45D 2/00* (2006.01)

(52) U.S. Cl. ..... 132/243; 132/223

(58) Field of Classification Search ..... 132/243, 132/212, 223, 224, 226, 227, 229, 230, 231, 132/232, 233–237, 240, 241, 244, 269, 271, 132/123, 143, 129, 254, 265, 76.2, 328; 219/222, 219/223, 225, 226, 227, 228, 229; 34/96, 34/283, 101; 392/379, 380, 374; 15/184; 401/107, 110, 111, 112, 115, 117
See application file for complete search history.

(56) References Cited

U.S. PATENT DOCUMENTS

| | | | | | |
|---|---|---|---|---|---|
| 1,355,026 | A | * | 10/1920 | Austin | 401/117 |
| 1,700,876 | A | * | 2/1929 | Blitz | 248/691 |
| 1,737,765 | A | * | 12/1929 | Jacobs | 132/232 |
| 1,847,522 | A | * | 3/1932 | Dahl | 132/243 |
| 1,995,359 | A | * | 3/1935 | Machtemes | 132/229 |
| 2,427,559 | A | * | 9/1947 | Johnson | 15/184 |
| 2,654,371 | A | * | 10/1953 | McIlrath | 132/226 |
| 3,759,271 | A | * | 9/1973 | Caruso | 132/233 |
| 3,926,200 | A | * | 12/1975 | Losenno | 132/219 |
| 4,101,757 | A | * | 7/1978 | Van Dyck et al. | 219/225 |
| 4,215,264 | A | * | 7/1980 | Hetherington | 219/225 |
| 4,358,660 | A | * | 11/1982 | Andis | 219/222 |
| D275,132 | S | * | 8/1984 | Van Deursen | D28/35 |
| 4,549,560 | A | * | 10/1985 | Andis | 132/232 |
| 4,851,641 | A | * | 7/1989 | Barowski et al. | 219/225 |
| 4,866,249 | A | * | 9/1989 | Howard | 219/225 |
| 5,664,588 | A | * | 9/1997 | Berry | 132/232 |
| 5,749,379 | A | * | 5/1998 | Stillwagon et al. | 132/200 |
| 6,622,735 | B2 | * | 9/2003 | Hirata et al. | 132/224 |
| 7,987,859 | B2 | * | 8/2011 | Cafaro | 132/225 |
| 2008/0041408 | A1 | * | 2/2008 | Shepherd et al. | 132/224 |
| 2009/0084396 | A1 | * | 4/2009 | Jerome et al. | 132/224 |
| 2011/0017225 | A1 | * | 1/2011 | Devulapalli | 132/118 |

* cited by examiner

*Primary Examiner* — Robyn Doan
*Assistant Examiner* — Vanitha Elgart
(74) *Attorney, Agent, or Firm* — Gulf Coast Intellectual Property Group

(57) ABSTRACT

A curling iron operable to protect a portion of the user's skin that is adjacent the heating element from incidental contact with the heating element. The curling iron further includes a handle that is integrally mounted to the heating element. A shield is slidably mounted to the handle and is configured to be deployed to substantially extend the length of the heating element. The shield is further configured to be rotatable about the circumference of the heating element so as to maintain a position such that the shield is intermediate the heating element and the user's skin.

19 Claims, 1 Drawing Sheet

CURLING IRON WITH RETRACTABLE HEAT SHIELD

FIELD OF THE INVENTION

The present invention relates to a hair styling device, more specifically but not by way of limitation, a heated curling iron that further includes a retractable and rotatable heat shield to protect the user's skin from the heating element during use.

BACKGROUND

Millions of women engage in hygiene and beauty routines on a daily basis. One part of such a daily routine often involves the styling and/or combing of their hair. Commonly, women will style their hair with the use of styling devices such as hair dryers and curling rollers. Another device that is commonly used to provide temporary shape to at least a portion of the women's hair is a curling iron.

As is known in the art, curling irons utilize a conventional heating element that is generally cylindrical in shape that can be heated to a temperature of approximately four hundred and thirty degrees. The heat facilitates the molding of the hair to the desired shape and the subsequent desired molded shape is usually further retained by the use of a hairspray. Conventional curling irons utilize a lever that is pivotally attached to the curling iron proximate the handle. The user typically biases the lever away from the heating element so as to create a space to grasp the hair by releasably securing the hair intermediate the lever and the heating element subsequent the lever being biased against the heating element. Ensuing placing the hair in this position, the user typically rolls the curling iron in a desired direction to produce a shape for the hair.

One problem with existing curling irons, is that during the rolling process, the heating element is exposed to the skin of the user generally in the neck and face region. As the user rolls the curling iron, the heating element thereof provides a significant risk to the user and routinely burns the skin of the face or neck region of the user. This is a common and known problem with existing curling irons.

Accordingly, there is a need for a styling aid, more specifically a heated curling iron that further includes the ability to protect the skin of the user in the face and neck region during utilization of the heated curling iron so as to substantially prevent burns to the user.

SUMMARY OF THE INVENTION

It is the object of the present invention to provide a hair styling aid, more specifically a heated curling iron that further includes a shield to protect the user's skin during the utilization of the heated curling iron.

Another object of the present invention is to provide a heated curling iron that includes a shield to protect the user's skin from burns that is retractable.

Yet a further object of the present invention is to provide a heated curling iron that includes a shield to protect the user's skin from burns during utilization wherein the shield is further rotatable about the heating element.

Another object of the present invention is to provide a heated curling iron that includes a retractable shield that is integrally mounted into the handle of the heated curling iron.

Still another object of the present invention is to provide a heated curling iron having a retractable shield integrally mounted into the handle of the heated curling iron that is manufactured of a heat insulating material such as but not limited to ceramic or porcelain.

Yet a further object of the present invention is to provide a heated curling iron that includes a retractable shield integrally formed into the handle of the heated curling iron that is easy to use with one hand.

Another object of the present invention is to provide an alternative embodiment of the present invention, wherein the alternative embodiment includes a handle having a retractable and rotatable heat shield that can be integrally mounted to a handle of a conventional curling iron without inhibiting utilization of conventional operational controls of the conventional curling iron.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
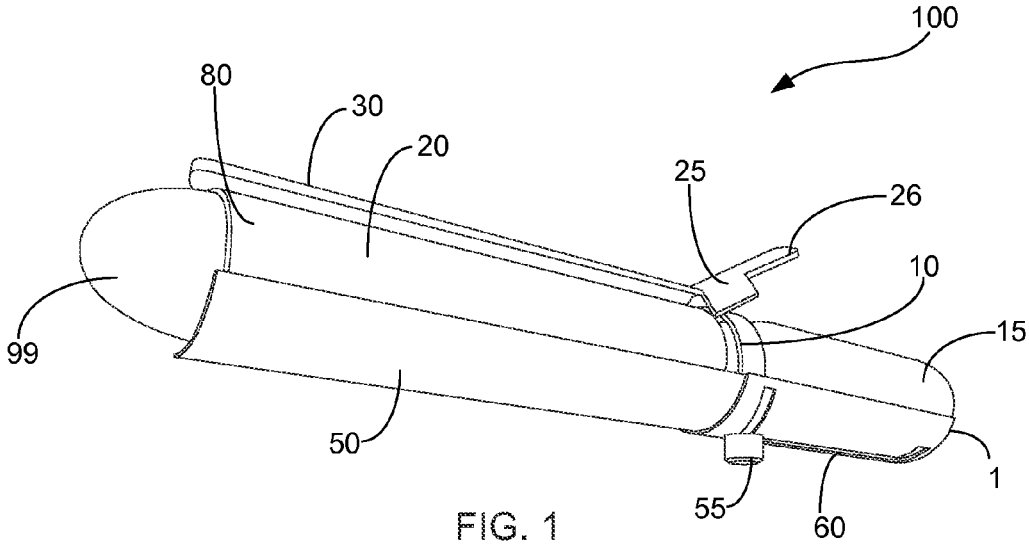
FIG. 1 is a perspective view of an embodiment of the present invention.

Referring now to the drawings submitted herewith, wherein various elements depicted therein are not necessarily drawn to scale and wherein through the views and figures like elements are referenced with identical reference numerals, there is illustrated a hair styling device 100 constructed according to the principles of the present invention.

Figure 2:
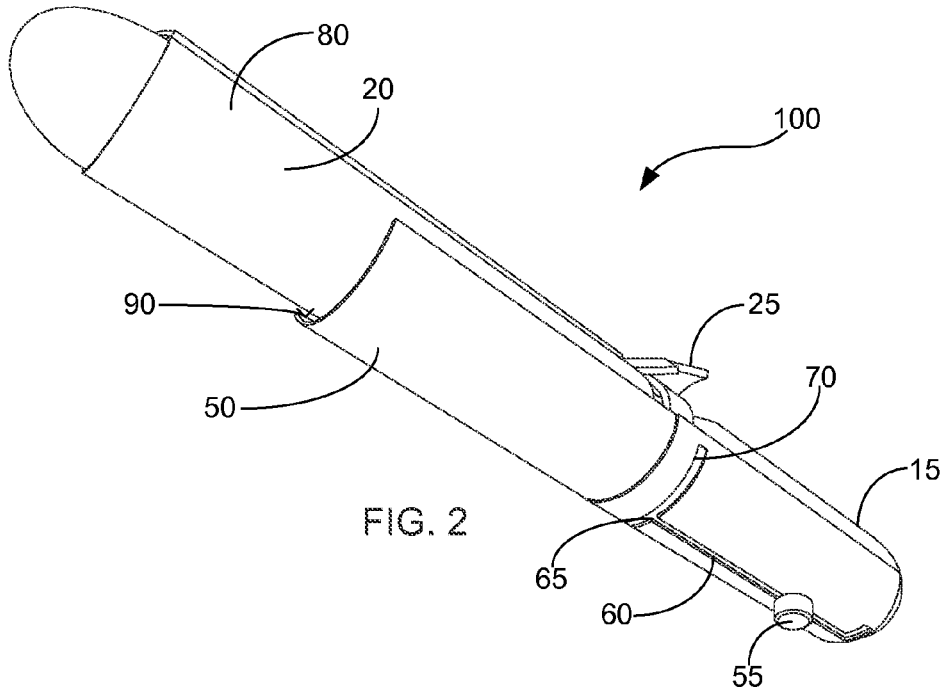
FIG. 2 is bottom perspective view of an embodiment of the present invention.

Referring in particular to FIGS. 1 and 2, the hair styling device 100 further includes a body 10 that is generally elongated and cylindrical in shape. The body 10 comprises a handle 15 and a heating element 20 that are integrally joined utilizing suitable and durable methods. The heating element 20 is cylindrical in shape and is manufactured from a suitable durable material such as but not limited to metal. The hair styling device 100 is operably couplable to a conventional power source such as but not limited to a 120 or 220 volt ac electrical outlet. Although not illustrated herein the heating element 20 has disposed therein conventional heating wires wherein subsequent to be operably coupled to an electrical source will provide a desired heat transfer to the heating element 20 facilitating the use of the hair styling device 100. It should be recognized by those skilled in the art that the heating element 20 could be manufactured in a variety of different lengths and diameters.

Mounted intermediate the handle 15 and the heating element 20 is a lever 25. The lever 25 is pivotally mounted to the body 10 utilizing suitable conventional methods. Integrally formed with the lever 25 is an arm 30. The arm 30 is generally elongated being planar and arcuate in shape. The arm 30 has a length that is approximately equivalent to the length of the heating element 20. The arm 30 is biased against the heating element 20 in its first position. The lever 25 functions to move the arm 30 to its second position wherein the user applied a downward force to the end 26 of the lever 25. Subsequent a downward force being applied to the end 26 of the lever 25 the arm 30 pivots away from the heating element 20 creating a space therebetween that is sufficient in size to accommodate a lock of hair. A user can release the downward force being applied to the end 26 of the lever 25 in order to move the arm 30 to its first position wherein the lock of hair intermediate the arm 30 and the heating element 20 is releasably secured and can be shaped with the hair styling device 100.

Integrally formed with the handle 15 and slidably and rotatably mounted thereto is a shield 50. The shield 50 is generally planar and arcuate in shape and functions to cover a portion of the circumference of the heating element 20. The shield 50 is manufactured from a suitable durable rigid material that has been shown to have heat-insulating properties. More specifically but not by way of limitation, it is contemplated within the scope of the present invention that the shield 50 can be manufactured from porcelain or ceramic. Additionally, it is contemplated within the scope of the present invention that the shield 50 could be manufactured from a rigid base such as metal and have a heat insulating material disposed on the exterior surface such as but not limited to a silica textile wrapping or glass fiber wrapping. The shield 50 functions to protect the user's skin from the heating element 20 that is most proximate thereto during use. Typically during use of the hair styling device 100 a portion of the circumferential surface 80 of the heating element 20 is exposed to the user's skin when the shield 50 is retracted. Deployment of the shield 50 positions the shield 50 intermediate the heating element 20 and the user's skin covering a portion of the circumferential surface 80 providing a substantially reduced potential of the user's skin contacting the heating element 20. A gap 90 exists between the deployed shield 50 and the heating element 20 so as to allow a sufficient amount of hair therebetween to allow normal operation of the hair styling device 100.

The shield 50 is operably connected to a knob 55. The knob 55 is manufactured from a suitable durable material such as but not limited to plastic. The knob 55 is generally annular in shape and extends outward from the handle 15. Those skilled in the art will recognize that the knob 55 could be manufactured in numerous different shapes and constructed from a vast array of material and still perform the desired function as described herein. The knob 55 is slidably mounted to the handle 15 and functions to deploy or retract the shield 50. The knob 55 traverses within the longitudinal channel 60 in order to deploy or retract the shield 50. When the knob 55 is moved in a direction towards the end 99 the shield 50 deploys from the handle 15 until the knob 55 reaches the stop 65. Subsequent to reaching the stop 65 in the longitudinal channel 60 the shield 50 is substantially deployed such that the shield 50 covers a portion of the circumferential surface 80 of substantially the length of the heating element 20. The knob 55 further functions to rotate the shield 50 about the circumferential surface 80 of the heating element 20. The knob 55 traverses within the lateral channel 70, which moves the shield 50 about the circumferential surface 80 of the heating element 20. This functions to provide the user of the hair styling device 100 more efficient protection from the heating element 20 during use and providing specific coverage of the heating element 20 that is most proximate the skin during utilization of the heating element 20. The lateral channel 70 function to allow the shield 50 to rotate about the circumferential surface 80 of the heating element with the exception of the portion that is engaged with the arm 30. This allows the arm 30 to be moved from its first position and then returned to its second position without interference from the shield 50. While the shield 50 is illustrated in the accompanying drawings submitted herewith as being slidably mounted to the handle 15, it is further contemplated within the scope of the present invention that the shield 50 could be spring-loaded within the handle 15 such that the user could depress the knob 55 and substantially deploy the shield 50 to its fully extended position.

Figure 3:
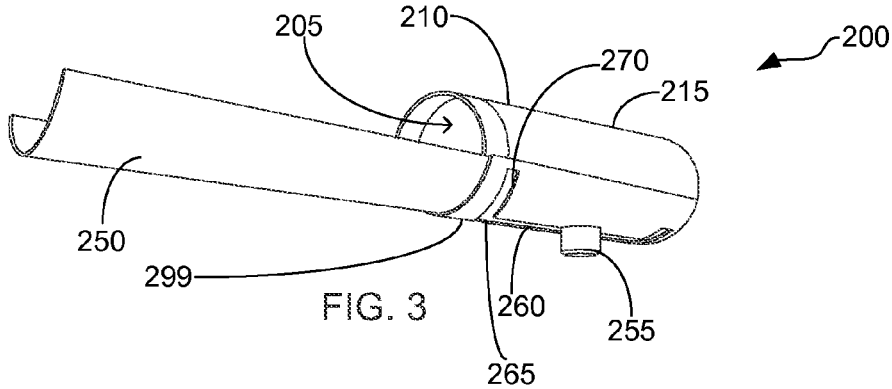
FIG. 3 is a perspective view of an alternative embodiment of the present invention.

Referring now to FIG. 3, an alternative embodiment of the present invention is illustrated therein. The hair styling device 200 further includes a body 210 that is generally cylindrical in shape having an interior volume 205. The body 210 functions to be mateably mounted over a handle to a conventional curling iron wherein the handle is journaled into the interior volume 205 of the body 210 and releasably secured through suitable durable methods such as but not limited to mechanical clasps, snaps and frictional keepers. It is further contemplated within the scope of the present invention that the body 210 subsequent placement over a handle of a conventional curling iron will not inhibit the use of any controls present on the handle of the conventional curling iron. More specifically but not by way of limitation, the body 210 could have apertures or slots present therein to accommodate controls such as but not limited to power switches.

The body 210 further includes a handle 215 that provides a user interface to operate the hair styling device 200. The handle 215 is manufactured from a suitable durable material and is manufactured to a suitable length to accommodate a handle of a conventional curling iron therein. Integrally mounted within the handle 215 is a shield 250. The shield 250 is generally planar and arcuate in shape and functions to cover a portion of the circumference of a heating element of a conventional curling iron. The shield 250 is manufactured from a suitable durable rigid material that has been shown to have heat-insulating properties. More specifically but not by way of limitation, it is contemplated within the scope of the present invention that the shield 250 can be manufactured from porcelain or ceramic. Additionally, it is contemplated within the scope of the present invention that the shield 250 could be manufactured from a rigid base such as metal and have a heat insulating material disposed on the exterior surface such as but not limited to a silica textile wrapping or glass fiber wrapping. The shield 250 functions to protect the user's skin from a heating element of a conventional curling iron that is most proximate thereto during use. Typically during use of a conventional curling iron, a portion of the circumferential surface of the heating element is exposed to the user's skin. Deployment of the shield 250 covers a portion of the circumferential surface providing a substantially reduced potential of the user's skin contacting the heating element. It is contemplated within the scope of the present invention that the shield 250 subsequent to being fully deployed from the handle 215 covers a portion of the circumferential surface of a heating element of a conventional curling iron that is substantially the length of the heating element.

A knob 255 is operably connected to the shield 250. The knob 255 is manufactured from a suitable durable material such as but not limited to plastic. The knob 255 is generally annular in shape and extends outward from the handle 215. Those skilled in the art will recognize that the knob 255 could be manufactured in numerous different shapes and constructed from a vast array of material and still perform the desired function as described herein. The knob 255 is slidably mounted to the handle 215 and functions to deploy or retract the shield 250. The knob 255 traverses within the longitudinal channel 260 and moves the shield 250 in the same direction. When the knob 255 is moved in a direction towards the end 299 the shield 250 deploys from the handle 215 until the knob 255 reaches the stop 265. Subsequent to reaching the stop 265 in the longitudinal channel 260 the shield 250 is substantially deployed such that the shield 250 covers a portion of the circumferential surface of substantially the length of the heating element of a conventional curling iron. The knob 255 further functions to rotate the shield 250 about the circumference of the heating element of a conventional curling iron. The knob 255 traverses within the lateral channel 270, which moves the shield 250 about the circumferential surface of the heating element of a conventional curling iron. This functions to provide the user of the hair styling device 200 more efficient protection from the heating element during use and providing specific coverage of the heating element that is most proximate the skin during utilization of a conventional curling iron.

Referring in particular to FIGS. 1 and 2, a description of the operation of the hair styling device 100 is as follows. In use, the user will engage the hair styling device 100 with a suitable power source and allow sufficient time for the heating element 20 to reach a desired temperature. Subsequent the heating element 20 reaching the desired temperature, the user will apply a downward force to the end 26 of the lever 25 facilitating the movement of the arm 30 from its original biased position. The user will then place the desired lock of hair intermediate the arm 30 and the heating element 20 and return the arm 30 to its original biased position. Subsequent to returning the arm 30 to its biased position the user will utilize a rotating motion until the desired amount of hair intermediate the arm 30 and the heating element 20 is rolled. The user then engages the knob 55 to deploy the shield 50 from the handle 15. The knob 55 is traversed through the longitudinal channel 60 until the knob 55 reaches the stop 65. In this position, the shield 50 is substantially deployed such that its extended length is approximately equivalent to the length of the heating element 20. The user engages the knob 55 as the hair styling device 100 is rotated to shape the hair as desired and the user traverses the knob 55 within the lateral channel 70 to rotate the shield 50 about the circumferential surface 80 of the heating element 20 such that the shield is intermediate the heating element 20 and the user's skin most proximate thereto. Ensuing completion of utilization of the hair styling device 100, the shield 50 is retracted into the handle 15.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A hair styling device comprising:

a body, said body being generally elongated and cylindrical in shape, said body further including a heating element and a handle, said heating element being integrally secured to said handle, said heating element having a first end and a second end, said second end being proximate said handle, said first end being distal to said handle, said first end being rounded in shape; and a shield, said shield being retractably mounted into said handle, said shield being generally planar in manner having an arcuate shape, said shield having a first position and a second position, said shield configured to extend substantially the length of said heating element in said second position, said shield being substantially retracted into said handle in said first position, said shield being adjacent said heating element in said second position, said shield being rotatably mounted to said handle such that said shield is positionable substantially around the circumference of said heating element; and wherein a void is present intermediate said heating element and said shield, said void being intermediate the entire length of said shield and said heating element subsequent said shield being deployed into said second position.

2. The hair styling device as recited in claim 1, and further including a first channel and a second channel, said first channel and said second channel being present in said handle, said first channel and said second channel including a passage.

3. The hair styling device as recited in claim 2, and further including a knob, said knob operably connected to said shield, said knob configured to traverse through said passage of said first channel and said second channel, said knob operable to provide an interface to transition said shield between said first position and said second position.

4. The hair styling device as recited in claim 3, wherein said first channel and said second channel are generally perpendicular with respect to each other.

5. The hair styling device as recited in claim 4, wherein said knob being operable to traverse through said passage of said second channel so as to rotate said shield about said heating element.

6. The hair styling device as recited in claim 5, wherein said second channel is configured to extend substantially circumferentially about said handle.

7. The hair styling device as recited in claim 6, wherein said shield is manufactured from a heat insulating material.

8. A safety device operable to be engaged with a conventional curling iron having a heating element comprising:

a body, said body being generally cylindrical in shape and substantially hollow, said body having a first end and a second end, said body further including an opening proximate said first end, said body further including a first channel and a second channel, said first channel being substantially the length of said body, said first channel having a first end and a second end, said first end of said first channel being proximate said first end of said body, said second channel being operably connected to said first channel, said second channel connected to said first channel proximate said first end of said first channel, said second channel being perpendicular to said first channel, said opening having a diameter sufficient in size to accommodate a handle of a conventional curling iron therein; and a shield, said shield retractably mounted to into said body, said shield having a first position and a second position, said shield being retracted into said body in said first position, said shield being generally planar in manner and arcuate in shape; said shield being extended outward from said body in said second position, said shield being rotatable about a heating element of a conventional curling iron, said shield operable to protect a user's skin from a heating element of a conventional curling iron.

9. The safety device as recited in claim 8, said shield being rotatable about at least a portion of the circumference of a heating element of a conventional curling iron in said second position.

10. The safety device as recited in claim 9, wherein in said second position said shield is adjacent the heating element of the conventional curling iron, a gap is intermediate said shield and the heating element, said gap being present the entire deployed length of said shield, said gap being sufficient in size to accommodate a portion of hair.

11. The safety device as recited in claim 10, and further including a knob, said knob operably connected to said shield, said knob being operably coupled with said first channel and said second channel, said knob operable to traverse along said first channel and said second channel, said knob operable to transition said shield between said first position and said second position upon traversing, along said first channel.

12. The safety device as recited in claim 11, wherein said knob is operable to rotate said shield about a heating element of a conventional curling iron upon traversing through said second channel.

13. The safety device as recited in claim 12, wherein said shield is manufactured from a heat insulating material.

14. A hair curling iron operable to protect a portion of a user's skin during use comprising:

a heating element, said heating element being generally elongated and cylindrical in shape, said heating element operable to be heated to approximately 430 degrees Fahrenheit, said heating element having a first end and a second end, an arm, said arm being pivotally mounted proximate said first end of said heating element, said arm having a first position and a second position, wherein said arm is biased against said heating element in said first position, said arm operable to releasably secure a portion of the user's hair adjacent to said heating element; and a handle, said handle integrally secured to said heating element proximate said first end, said handle being generally cylindrical in shape, said handle further including a shield, said shield being generally planar and arcuate in shape, said shield being retractably mounted into said handle, said shield having a first position and a second position, said shield operable to move between said first position and said second position, said shield being deployed from said handle and adjacent said heating element when in said second position, said shield and said heating element having a void intermediate thereto when said shield is in said second position, said void being the length of the deployed portion of said shield, said handle further including a first channel and a second channel, said first channel being substantially the length of said handle, said first channel having a first end and a second end, said first end of said first channel being proximate said first end of said heating element, said second channel being operably connected to said first channel, said second channel connected to said first channel proximate said first end of said first channel, said second channel being perpendicular to said first channel, said shield operable to be intermediate said heating element and a user during use so as to protect a user from burns.

15. The hair curling iron as recited in claim 14, and further including a knob, said knob operably connected to said shield said knob being operably coupled with said first channel and said second channel, said knob operable to traverse along said first channel and said second channel.

16. The hair curling iron as recited in claim 15, wherein said shield is rotatable about at least a portion of the heating element as said knob is traversed through said second channel.

17. The hair curling iron as recited in claim 16, wherein said shield is transitioned between said first position and said second position as said knob is traversed along said first channel.

18. The hair curling iron as recited in claim 17, wherein said first channel and said second channel are perpendicular with respect to each other.

19. The hair curling iron as recited in claim 18, wherein said shield is manufactured from a heat insulating material.

* * * * *